US011609515B2

(12) United States Patent
Leoni et al.

(10) Patent No.: US 11,609,515 B2
(45) Date of Patent: Mar. 21, 2023

(54) POLARITY FIXATION OF INK PARTICLES

(71) Applicant: Hewlett-Packard Development Company, L.P., Spring, TX (US)

(72) Inventors: Napoleon J. Leoni, Palo Alto, CA (US); Omer Gila, Palo Alto, CA (US); Rajesh Kelekar, Palo Alto, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/256,361

(22) PCT Filed: Oct. 23, 2018

(86) PCT No.: PCT/US2018/056974
§ 371 (c)(1),
(2) Date: Dec. 28, 2020

(87) PCT Pub. No.: WO2020/086059
PCT Pub. Date: Apr. 30, 2020

(65) Prior Publication Data

US 2021/0240111 A1 Aug. 5, 2021

(51) Int. Cl.

| | |
|---|---|
| ***G03G 15/20*** | (2006.01) |
| ***B41J 11/00*** | (2006.01) |
| ***G03G 9/18*** | (2006.01) |
| ***G03G 15/10*** | (2006.01) |

(52) U.S. Cl.
CPC ..... *G03G 15/20* (2013.01); *G03G 9/18* (2013.01); *G03G 15/102* (2013.01); *B41J 11/002* (2013.01)

(58) Field of Classification Search
CPC ..... B41J 11/002–00218
See application file for complete search history.

(56) References Cited

U.S. PATENT DOCUMENTS

| | | | | |
|---|---|---|---|---|
| 4,822,702 A | | 4/1989 | Hoshi et al. | |
| 5,255,062 A | | 10/1993 | Oka et al. | |
| 5,283,615 A | | 2/1994 | Yokoyama et al. | |
| 5,537,198 A | * | 7/1996 | Jackson | G03G 15/0152 399/168 |
| 6,168,259 B1 | | 1/2001 | Capurso | |

(Continued)

FOREIGN PATENT DOCUMENTS

| | | |
|---|---|---|
| EP | 0561419 A2 | 9/1993 |
| EP | 1591268 A1 | 11/2005 |

(Continued)

*Primary Examiner* — Leon W Rhodes, Jr.
(74) *Attorney, Agent, or Firm* — Michael Dryja

(57) ABSTRACT

A device includes a first portion and a first charge source. The first portion is located along a travel path of a substrate and is to receive ink particles within a carrier fluid in a pattern onto the substrate to at least partially form an image. The first charge source is downstream along the travel path from the first portion and is to emit first polarity charges to charge the at least first color ink particles to move, via electrostatic attraction through the first carrier fluid, to become electrostatically fixed in the pattern relative to the substrate. Via the first charge source or a subsequent charge source, further emission of opposite second polarity charges are to maintain electrostatic fixation of the ink particles in the pattern relative to the substrate.

17 Claims, 8 Drawing Sheets

(56) References Cited

U.S. PATENT DOCUMENTS

| | | | | |
|---|---|---|---|---|
| 6,428,862 | B1 * | 8/2002 | Noguchi | C09D 11/101 427/511 |
| 6,719,423 | B2 * | 4/2004 | Chowdry | B41M 5/0256 347/103 |
| 6,932,469 | B2 * | 8/2005 | May | B41J 2/01 204/508 |
| 7,422,312 | B2 * | 9/2008 | Kadomatsu | B41J 11/0021 347/55 |
| 7,651,212 | B2 * | 1/2010 | Kadomatsu | B41J 11/0015 347/100 |
| 8,491,086 | B2 * | 7/2013 | Gila | B41J 2/04 347/22 |
| 8,605,406 | B2 | 12/2013 | Jendrejack et al. | |
| 8,804,297 | B2 | 8/2014 | Blitshteyn et al. | |
| 9,428,655 | B2 | 8/2016 | Bar-Haim et al. | |
| 2003/0066751 | A1 | 4/2003 | May et al. | |
| 2014/0010577 | A1 | 1/2014 | Devlieghere et al. | |
| 2014/0015893 | A1 | 1/2014 | Marcus et al. | |
| 2015/0277273 | A1 | 10/2015 | Shoji et al. | |
| 2016/0282741 | A1 | 9/2016 | Uchino et al. | |

FOREIGN PATENT DOCUMENTS

| | | | | |
|---|---|---|---|---|
| JP | 11323227 A | * | 11/1999 | B41C 1/105 |
| JP | 2013-215985 A | | 10/2013 | |

* cited by examiner

POLARITY FIXATION OF INK PARTICLES

BACKGROUND

Modern printing techniques involve a wide variety of media, whether rigid or flexible, and for a wide range of purposes. In some types of printing, ink particles can be deposited on media via a fluid ejection device.

DETAILED DESCRIPTION

Figure 1A:
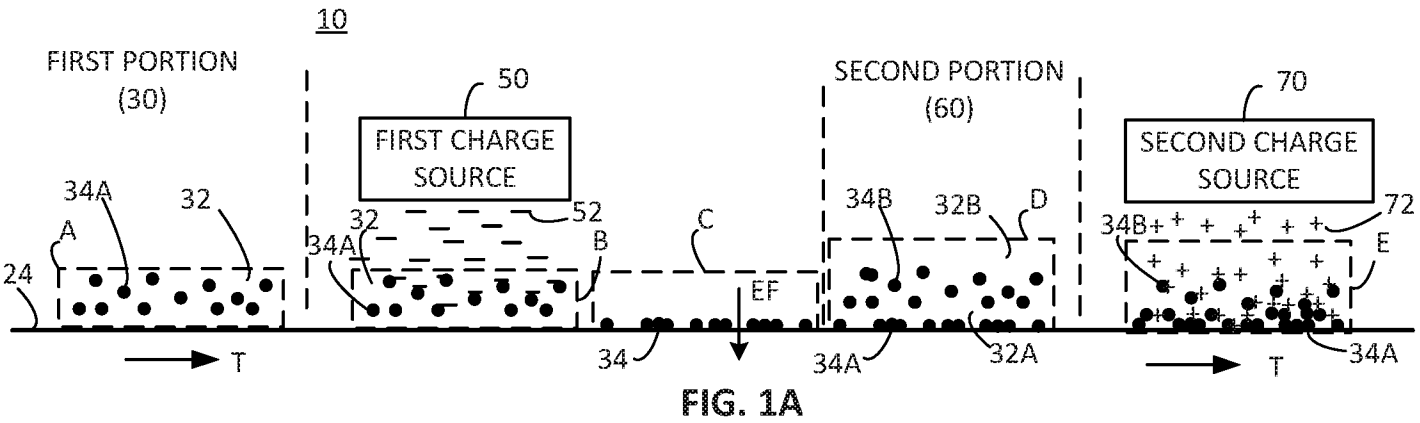
FIG. 1A is a diagram schematically representing an example device and/or example method of image formation.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense. It is to be understood that features of the various examples described herein may be combined, in part or whole, with each other, unless specifically noted otherwise.

At least some examples of the present disclosure are directed to image formation devices and/or methods which may comprise switching a polarity of charges applied to ink particles to maintain electrostatic fixation of the ink particles relative to a substrate.

In some examples, a device comprises a first portion and a first charge source. The first portion is to receive first ink particles within a first fluid onto a substrate to form an image. The first charge source is downstream from the first portion and is to emit first polarity charges to charge the first color ink particles to move through the first fluid to become electrostatically fixed relative to the substrate.

In some such examples, the device comprises a second portion downstream from the first charge source, with the second portion to receive, relative to the substrate, second ink particles within a second fluid to further form the image. A second charge source is downstream from the second portion and is to emit opposite, second polarity charges to charge the second ink particles to move through the first and second carrier fluids to become electrostatically fixed relative to the substrate. Upon application of the opposite, second polarity charges, the previously deposited first ink particles (which originally received first polarity charges) also become charged according to the opposite, second polarity. Accordingly, the polarity of charges which electrostatically fix the first ink particles have been switched, such as from negative to positive in some examples, or from positive to negative in some examples.

At or around the time of the switching of polarity of charges on the already deposited first ink particles, the first ink particles may exhibit no positive or negative charges. However, either because of the high speed at which the switching occurs (e.g. within a few microseconds), a lack of tendency for ink particles to migrate, and/or some possible chemical adhesion, the first ink particles tend to remain in their intended position and pattern on the substrate during the switching of polarity of charges on those ink particles.

In some such examples, the first and second fluids may comprise a dielectric carrier fluid, which also may comprise a non-aqueous fluid.

In some examples, the device comprises a first portion and a series of first and second charge sources downstream from the first portion and arranged in an alternating pattern with the first charge sources emitting first polarity charges (e.g. negative charges) and the second charge sources emitting opposite second polarity charges (e.g. positive charges). The series of respective first and second charge sources are to maintain the electrostatic fixation of the first ink particles relative to the substrate for a total period of time, and/or distance along a travel path of the substrate until further action (e.g. transfer, deposit of additional ink particles, etc.)

occurs. It will be understood that in some examples, the first charge sources may emit positive charges while the second charge source may emit negative charges.

Via at least some such example arrangements, the switching of polarity of charges may maintain electrostatic fixation of ink particles relative to a substrate, particularly in cases in which the substrate may exhibit properties (e.g. high electrical conductivity) which may tend to expedite discharge of the charges from the ink particles.

Such example arrangements may enable or enhance electrostatic fixation of ink particles relative to a substrate. At least some situations in which such example arrangements may be employed involves the use of high conductivity carrier fluids and/or types of substrates (e.g. flexible metallic packaging media) which may cause relatively faster discharge of the charges which otherwise are generally retained long enough on the ink particles in order to maintain electrostatic fixation of the ink particles relative to the substrate. In some situations, such as when multiple different color ink particles are separately deposited on a substrate in consecutive actions each involving single polarity charging of the ink particles, each iteration may contribute to an ongoing buildup of voltage on the substrate. This voltage build-up may interfere with electrostatic attraction and fixation of subsequently deposited charged ink particles, which in turn can lead to lower quality images because of the ink particles not being sufficiently attracted to the substrate and/or not securely retained relative to the substrate.

However, via at least some of example arrangements of the present disclosure, switching the polarity of the charges in each iteration of applying charges may neutralize charges which otherwise might build up on the substrate (and cause voltage buildup) and may apply a new set of charges to re-establish (and therefore maintain) electrostatic fixation of the ink particles relative to the substrate and/or to newly establish electrostratic fixation of additional ink particles being deposited.

In some examples, the polarity switching of charges applied to ink particles may be employed when binder materials (on the ink particles, carrier fluid, etc.) omit properties of chemical adhesion relative to the substrate prior to the later application of heat or other energy at a transfer station. Stated differently, in the absence of significant chemical adhesion between the ink particles and the substrate, the example polarity-switching-based application of charges to the ink particles may establish and/or maintain electrostatic fixation of the ink particles relative to the substrate. In one aspect, this arrangement may ease constraints on the types and/or quantities of binder materials which otherwise might be employed to establish or enhance fixation (e.g. via chemical adhesion) of ink particles relative to a substrate. With this in mind, some examples may sometimes be referred to as establishing electrostatic fixation without significant binder-based chemical adhesion or without any binder-based chemical adhesion.

These examples, and additional examples, are described below in association with at least FIGS. 1A-14.

FIG. 1A is a diagram schematically representing an example image formation device 10 and/or associated method of image formation. As shown in FIG. 1A, in some examples the device 10 comprises a first portion 30, a first charge source 50, a second portion 60, and a second charge source 70.

The first portion 30 of image formation device 20 is located along and/or forms a portion of the travel path T of a movable substrate 24, and is to receive droplets of ink particles 34A within a carrier fluid 32A on the substrate 24. The depiction within the dashed lines A in FIG. 1A represents ink particles 34A and carrier fluid 32A after being received on substrate 24 to form at least a portion of an image on the substrate 24. In some examples, the droplets from which ink particles 34A are formed may comprise pigments, dispersants, the carrier fluid 32A, and/or additives such as bonding polymers. In some examples, the carrier fluid 32A may comprise a dielectric fluid and may comprise a non-aqueous fluid.

In at least some examples, the substrate 24 may be in electrical connection with a ground element, such as later further described in at least the examples of FIGS. 4A-4D, 7, etc. In some examples, the ground element may comprise an electrically conductive element, which may comprise a roller, brush, plate, etc. in rolling or slidable contact, respectively, with a portion of the substrate 24. The ground element may be in contact with an edge or end of the substrate 24. In other cases, the ground could be a conductive belt in contact with the substrate 24 moving in the same direction of the substrate 24.

Figure 2:
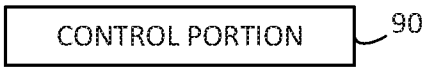
FIG. 2 is a block diagram schematically representing an example control portion of an example image formation device.
Figure 1B:
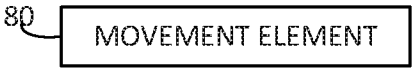
FIG. 1B is a block diagram schematically representing an example movement element of an example image formation device.

With this in mind, it will be understood that some example image formation devices (e.g. 10 in FIG. 1A) may comprise a movement element 80 as shown in FIG. 1B, which is associated with the substrate 24. The movement element 80 is to move the substrate 24 along travel path T including the first portion 30, the first charge source 50, etc. At least some example implementations of the movement element 80 are described below in association with at least FIGS. 5-10. In some examples, the example image formation device 10 in FIG. 1A may comprise a control portion 90, as shown in FIG. 2. Among other operations and functions, in some examples the control portion 90 is to control, via the movement element 80, movement of the substrate 24 along the travel path in a manner to enable and/or maintain electrostatic fixation of ink particles according to the operation of the first charge source 50, second charge source 70, etc.

In some examples, the control portion 90 also may control a flux intensity of charges emitted by the charge source(s) 50, 70. With this in mind, an appropriate amount of charges may be applied to the ink particles 34A, 34B and substrate 24, given a known distance along the travel path T over which the charges will be applied for each respective charge source, the substrate speed, and the flux intensity, etc. Moreover, given this information one can also determine the number of different polarity charge sources, their relative spacing, etc. in order to induce and/or maintain a desired polarity-switching-based, electrostatic fixation of ink particles relative to substrate 24. In some examples, the substrate 24 may be exposed to charges from a respective charge source having a particular polarity for a time period within a range of about 10 to about 30 milliseconds for a given substrate speed and effective width of the flux of charges from the respective charge source. In some such examples, this time period falls within a range of about 15 milliseconds to about 25 milliseconds. In some examples, the time period is about 20 milliseconds.

The substrate 24 may comprise one of a variety of different types of substrates. In some examples, the substrate 24 may comprise a transfer member, such as a blanket of the type used in liquid electrophotographic (LEP) printing or other printing or such as a belt or web (e.g. 711 in FIG. 10A). In some examples, the substrate 24 may additionally comprise a primer layer (e.g. P in FIG. 7) or comprise an electrically charged, semi-liquid image-receiving holder layer (e.g. 425 in FIGS. 8A-8B, 9A) supported by and carried by such a transfer member (e.g. 423, 480 in FIGS.

8A-8B, 9A). In some examples, the substrate 24 may comprise an image formation medium supported and carried by a transfer member. Further details regarding at least some of these examples of substrate 24 are provided below in the context of various specific example implementations.

In some examples the substrate 24 may comprise an image formation medium, including but not limited to a flexible packaging media, such as a plastic media. In some such examples, the movement element 80 (FIG. 1B) used to move the substrate 24 may comprise a media roll-to-roll arrangement, such as the example media roll-to-roll arrangement described in association with FIG. 5.

In some examples in which the substrate 24 comprises an image formation medium, the substrate 24 may comprise polyethylene (PET) material, which may comprise a thickness on the order of about 20 micrometers or about 60 micro meters in some examples. In some such examples, upon receiving charged ink particles (which become electrostatically fixed to the PET material) and receiving some free charges which may not become adhered to the ink particles, the PET material may exhibit on the order of 1000 Volts for a PET material having a thickness of about 20 micrometers and may exhibit on the order of a few thousands volts for a PET material having a thickness of about 60 micrometers. In some such examples, this voltage at the PET material substrate 24 may be produced via a charge source, such as a corona operating on the order of 5000, 6000, 7000 Volts, or 8000V. It will be understood that in some examples, the PET material forming substrate may comprise example thicknesses on the order of 10, 30, 40, 50, 70, etc. micrometers and a correspondingly appropriate voltage.

In some examples, as an image formation medium, the substrate 24 may comprise a biaxially oriented polypropylene (BOPP) material. In some examples, as an image formation medium, the substrate 24 may comprise a biaxially oriented polyethylene terephthalate (BOPET) polyester film, which may be sold under trade name Mylar in some instances. In some examples, as an image formation medium, the substrate 24 or portions of substrate 24 may comprise a metallized foil or foil material, among other types of materials.

In some examples, the substrate 24 may comprise other types of materials which provide at least some of the features and attributes as described throughout the examples of the present disclosure.

As further shown in FIG. 1A, the first charge source 50 of image formation device 10 is located downstream from the first portion 30 along travel path T. The first charge source 50 is to emit first polarity charges 52 to charge the first color ink particles 34. Once charged, the ink particles 34A move, via electrostatic attraction relative to the grounded substrate 24, through the carrier fluid 32A toward the substrate 24 (as represented via dashed box B) to become electrostatically fixed on or relative to the substrate 24. The end result of their migration or movement is represented via the depiction in dashed lines C in FIG. 1A. Further details are described more fully later in association with at least FIGS. 4A-4D regarding the adherence of charges 52 to ink particles 34A in a suspended state within carrier fluid 32A, movement of the charged ink particles 34A, and/or their electrostatic fixation relative to substrate 24.

With further reference to FIG. 1A, in some examples the charge source 50 may comprise a cold plasma generator, which may comprise a corona, plasma element (e.g. cold plasma element), or other charge generating element to generate a flow or flux of charges 52. In some such examples, the charge generating element(s) may comprise a scorotron, array of needle electrodes, and the like.

The generated charges may be negative or positive as desired. In some examples, the charge source 50 may comprise an ion head to produce a flow of ions as the charges 52. It will be understood that the term "charges" and the term "ions" may be used interchangeably to the extent that the respective "charges" or "ions" 52 embody a negative charge or positive charge (as determined by source 50) which can become attached to the ink particles 34 to cause all of the charged ink particles to have a particular polarity, which will be attracted to ground or an electrically conductive element of opposite polarity.

In some such examples, for a given flux of charges emitted by a charge source (e.g. 50) all or substantially all of the charged ink particles (e.g. 34A) will become negatively charged or alternatively all or substantially all of the charged ink particles 34A will become positively charged. While the charges 52 shown in FIGS. 1A, 3, etc. are depicted as having a particular polarity (positive or negative), it will be understood that the polarity of charges 52 may be selected and implemented in view of the polarity of other elements of an example image formation device (or associated with an example image formation device), such as a polarity of elements (e.g. charge directors, binder particles) within an electrically charged, image-receiving holder layer (e.g. 425 in FIGS. 8A-9B). It will be understood that other elements such as at least a portion of the substrate 24 and/or other elements (e.g. transfer member 423, 480 in FIGS. 8A-9B) in contact with (or otherwise coupled to) substrate 24 may exhibit, may develop, or be caused to exhibit charges having a polarity opposite from the polarity of the charges 52 (and therefore opposite from the polarity of the charged ink particles 34). Via such example arrangements of opposite polarity charges, the electrostatic attraction forces may be at least partially implemented. In some examples, the charges 52 may affect the charge level and/or the polarity of image-receiving holder layer (e.g. 425 in FIGS. 8A-9B) to keep the electrostatic attraction forces of particles 34A at least partially implemented.

Via at least some of the above-described example arrangements, the charged ink particles 34A become electrostatically fixed (as represented by arrows EF) on the substrate 24 in a location on the substrate 24 generally corresponding to the location (in an x-y orientation) at which they were initially received onto the substrate 24 in the first portion 30 of the image formation device 10. Via such electrostatic fixation (e.g. pinning), the ink particles 34 will retain their position on substrate 24 even when other ink particles (e.g. different colors) are added later, excess liquid is mechanically removed, physically removed, etc. It will be understood that while the ink particles may retain their position on substrate 24, some amount of expansion of a dot (formed of ink particles) may occur after the ink particles 34 (within carrier fluid 32) are jetted onto substrate 24 and before they are electrostatically pinned. In some examples, the charge source 50 is spaced apart by a predetermined distance (e.g. downstream) from the location at which the droplets are received (or ejected) with the distance selected in order to delay the electrostatic fixation (per operation of charge source 50), which can in turn cause an increase in dot size on substrate 24, which may in turn may lower ink consumption. It is noted that in some examples, once the ink particles are electrostatically fixed relative to the substrate 24, some minimal dot expansion could occur due to repulsion electrical forces between particles or diffusion.

As further shown in FIG. 1A, the second portion 60 of image formation device 10 is downstream (along a travel path of substrate 24) from the first charge source 50. The second portion 60 is to receive, relative to the substrate 24, second ink particles 34B within a second fluid 32B to further form the image. As represented via dashed box D, the second ink particles 34B and second fluid 32B are deposited on top of the first ink particles 34A and first fluid 32A. In some examples, the second portion 60 may comprise at least some of substantially the same features as first portion 30, except for its different location and receipt of different second ink particles 34B, which may be a different color than the first ink particles 34A.

As further shown in FIG. 1A, the second charge source 70 is downstream from the second portion 60 and is to emit opposite, second polarity charges 72 to charge the second ink particles 34B to move through the first and second carrier fluids 32A, 32B on their way to become electrostatically fixed (along with ink particles 34A) relative to the substrate 24, as represented via dashed box E.

It will be understood that in some examples, device 10 may comprise additional portions (e.g. like portions 30, 60) to receive additional ink particles further form an image relative to substrate 24, and with each such portion being followed by a corresponding charge source (like charge sources 50, 70) to emit charges having a polarity opposite the charges emitted by a preceding charge source. Via such example arrangements, additional different color particles may be added as desired to the image being formed relative to substrate 24. Upon each additional layer of color ink particles being deposited, additional charges are applied to cause movement of the newly added ink particles toward the substrate 24, and to maintain electrostatic attraction of the already electrostatically fixed ink particles (e.g. 34A) to remain electrostatically fixed relative to the substrate 24. It will be understood that each subsequent addition of ink particles may be accompanied by using a polarity of charges opposite the polarity of charges applied in association with the preceding deposit of ink particles.

Figure 3:
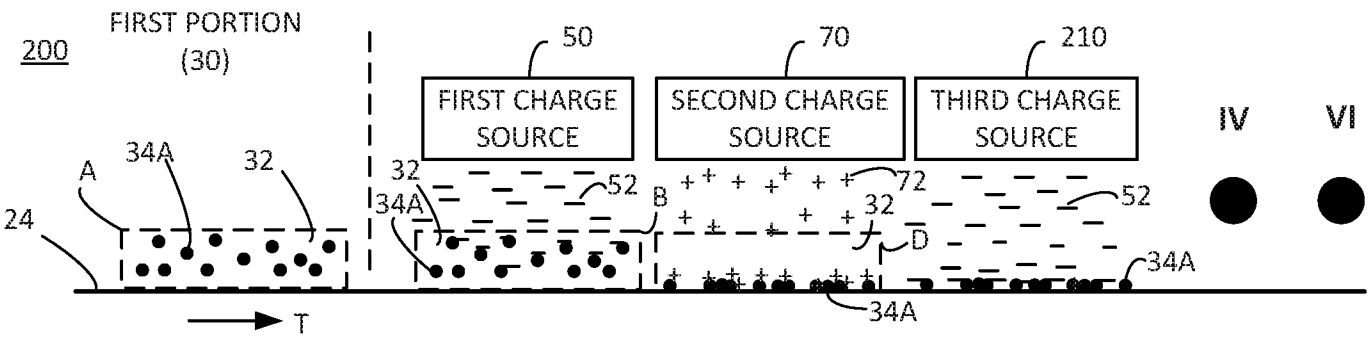
FIG. 3 is a diagram schematically representing an example device and/or example method of image formation.

FIG. 3 is a diagram schematically representing an example device 200 comprising at least some of substantially the same features and attributes as example device 10, except comprising a single first portion 30 with several charge sources following the first portion 30. In particular, as shown in FIG. 3, the device 200 may comprise a first charge source 50 located downstream (along travel path T) from the first portion 30 and which emits charges having a first polarity (e.g. negative).

Device 200 also may comprise a second charge source 70 downstream from the first charge source 50 and emit charges having an opposite second polarity (e.g. positive). In some such examples, there are no structures (e.g. fluid ejection device, other) intervening between the first charge source 50 and the second charge source 70. However, it will be understood that in some examples there may be some spacing between the consecutively arranged first and second charge sources 50, 70. Each charge source (e.g. 50, 70) is sized and arranged to emit a flux of charges to cover a selectable area or size of ink particles (e.g. 34A) on the substrate 24.

As further shown in FIG. 3, in some examples a third charge source 210 is downstream along the travel path T from the second charge source 70. The third charge source 210 is to emit first polarity charges (e.g. negative) like the first polarity charges emitted via the first charge source 50 and which are opposite in polarity to the charges (e.g. positive) emitted by the immediately preceding second charge source 70. As further shown FIG. 3, black dots IV and V schematically represent that in some examples, additional charge sources may follow after the third charge source 210.

The series of alternating charge sources (e.g. 50, 70, 210, etc.) may be arranged to induce and/or maintain electrostatic fixation of deposited ink particles for a selectable length of movement of substrate 24 along travel path T and/or for a desired length of time.

With further reference to FIG. 3, in some examples a second portion like second portion 60 in FIG. 1A may follow (along the travel path T) the last charge source in the series of charge sources (e.g. 50, 70, 210, etc.) in order to apply additional ink particles (e.g. 34B in FIG. 1A) onto the previously deposited ink particles 34A which are already electrostatically fixated relative to substrate 24. It will be understood that such a second portion may also be followed by one or several charge sources to induce, establish, and/or maintain electrostatic fixation of the additional ink particles 34B and the ink particles 34A.

While not shown explicitly in the examples of FIGS. 1A and 3, it will be understood that in some examples a liquid removal element (e.g. 252 in FIG. 9A; 740 in FIG. 10A or 11; 805A, 805B in FIG. 10B) may be interposed between consecutive charge sources, such as between elements 50 and 70 in FIG. 1A or such as between elements 70 and 210 in FIG. 3. In some examples, such as liquid removal element may be interposed between a first charge source (e.g. 50 in FIG. 1A) and a second portion to receive droplets of ink particles and carrier fluid (e.g. 60 in FIG. 1A). In such examples, the liquid removal element can remove excess liquid after deposit and at least initial electrostatic fixation of ink particles. In some instances, this excess liquid may sometimes be referred to as supernatant liquid because it is generally suspended above the electrostatically fixed ink particles.

Figure 12A:
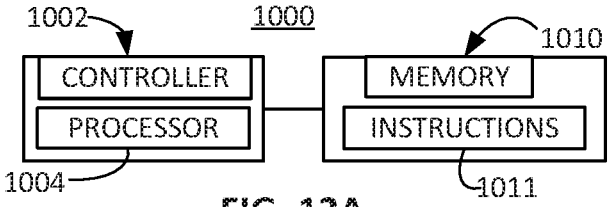
FIGS. 12A and 12B are each a block diagram schematically representing an example control portion and an example user interface, respectively.

In some examples, device 200 may comprise a control portion to control timing and operation of the first portion 30, the charge sources 50, 70, 210, etc., movement of the substrate 24, etc. In some examples, the control portion may comprise at least some of substantially the same features and attributes as the example control portion 90 in FIG. 2 and/or may comprise one example implementation of the later described control portion 1000 (FIG. 12A).

Figure 4A:
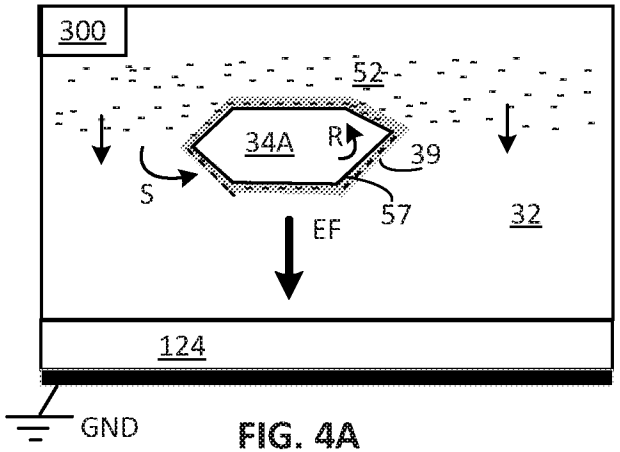
FIGS. 4A-4D are a series of diagrams which each schematically represent electrostatic migration and fixation of ink particles in an example device and/or example method of image formation.
Figure 4B:
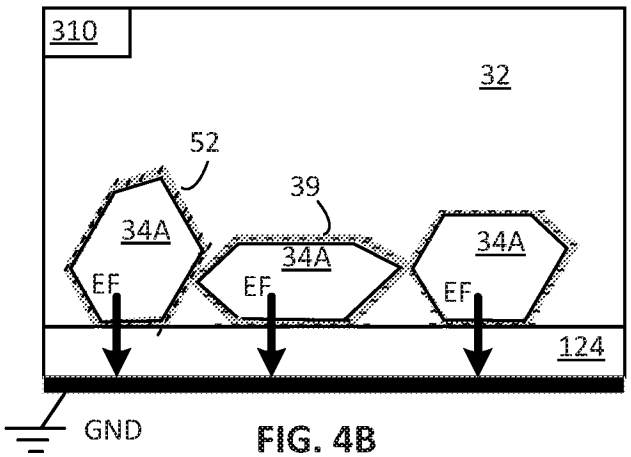

FIGS. 4A-4D are a series of diagrams which each schematically represent electrostatic migration and fixation of ink particles in an example image formation device and/or example method of image formation. FIG. 4A is a diagram 300 including a side view schematically representing charges 52 (after emission from a charge source 50) engaging an ink particle 34A, which represents engagement of charges 52 with any number of such ink particles 34A. In some examples, at least some of the charges 52 become adhered onto a surface 57 of the ink particle 34A.

In some examples, the received ink particles 34A may comprise a coating 39 made of a binder material to which charges 52 may become adhered of charges 52. In some such examples, the binder material may be or become active without receiving heat or radiation. In some examples, the carrier fluid 32 may comprise some binder material. In some examples, a binder material may be supplied on the substrate (e.g. transfer member 423 in FIG. 8A) or may be supplied as the substrate, such as when developer 402 in FIG. 8A deposits an image holder layer 425 of "ink-free" binder material with the image holder layer 425 acting as the substrate to which the ink particles are electrostatically fixed.

With at least some of the emitted charges 52 adhered to ink particle 34A, the ink particle 34A becomes electrostatically attracted to the substrate 124 as represented by force arrow EF. This electrostatic attraction, in turn, induces movement of the ink particle 34A to the substrate 124 until the ink particle 34A engages the surface 127 of the substrate 124 as shown in diagram 310 of FIG. 4B, with the electrostatic forces (EF) holding the ink particles 34A against the substrate 124.

Figure 4C:
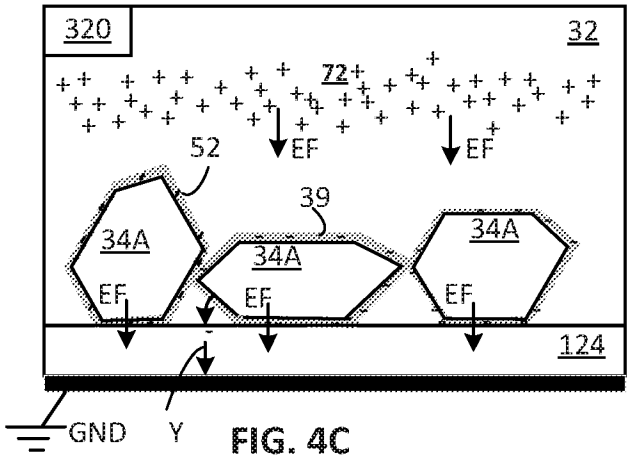

As previously described, after a period of time and/or when substrate 124 is made of a material which tends to foster discharge of the charges 52 on ink particle 34A, the ink particles 34A may tend to lose a significant portion of the previously-adhered charges, as represented in the diagram 320 of FIG. 4C by the relatively few remaining negative charges at the surface 57 of the ink particles 34A. Moreover, the relatively shorter and thinner arrows EF in FIG. 4C also represent the weakening electrostatic forces exerted by the remaining first polarity charges (e.g. negative).

However, as also shown via FIG. 4C, via examples of the present disclosure, further charges may be applied to the ink particles 34A to maintain their electrostatic fixation relative to the substrate 124. In such examples, the additional charges (e.g. 72) have an opposite polarity (e.g. positive in FIG. 4C) than the polarity (e.g. negative) of charges 52 which first applied to the ink particles (e.g. FIGS. 4A-4B). It will be understood that in some examples the first applied charges 52 may be positive charges while the opposite second polarity charges 72 may be negative charges.

Figure 4D:
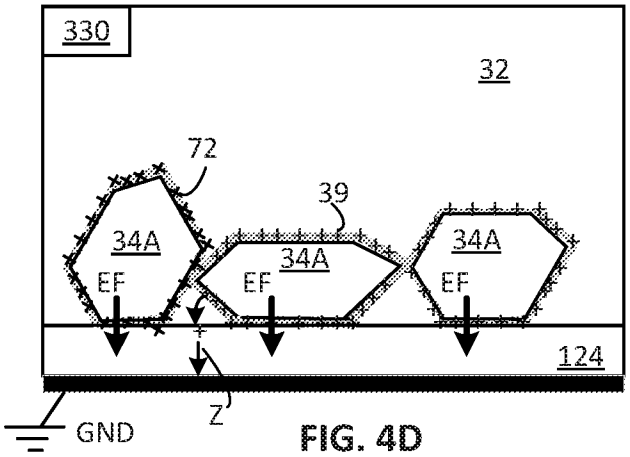

In this example arrangement, upon application of the opposite second polarity charges (e.g. 72) the charges 72 become adhered to the surface 57 of the ink particles 34A, as shown in FIG. 4D, and electrostatically attracted relative to the substrate 124 to cause the ink particle 34A as a whole to remain electrostatically fixed relative to the substrate 124.

The application of the opposite second polarity charges 72, such as shown in FIG. 4C, may occur after a selectable period of time such that the new charges 72 may be applied prior to significant dissipation of the first polarity charges 52, which might otherwise result in ink particles 34A becoming released from the substrate 124.

In a manner similar to that described in association with at least FIGS. 1A-3, it will be understood that in some examples different charge sources (e.g. FIGS. 1A, 3), may be used to emit the respective first polarity charges (e.g. 52 in FIG. 4A) and the opposite second polarity charges (e.g. 72 in FIG. 4C). Furthermore, it will be understood that in some examples, a second layer of ink particles (e.g. 34B in FIG. 1A) may be deposited onto the charged ink particles (e.g. 34A) prior to application of the opposite, second polarity charges onto the first polarity-charged ink particles 34A and substrate 124.

Figure 5:
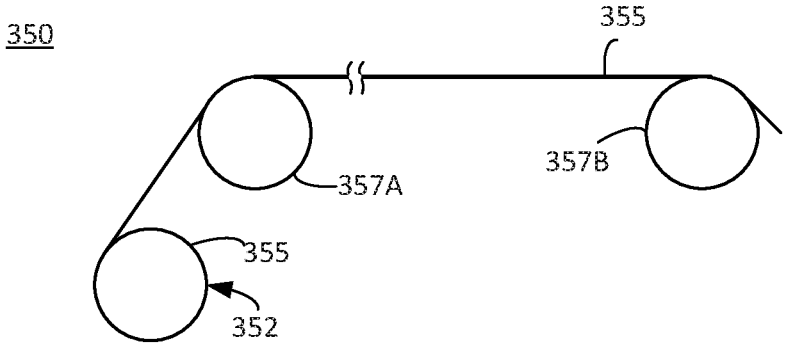
FIG. 5 is a side view schematically representing an example media supply of an example device and/or example method of image formation.

FIG. 5 is a side view schematically representing an example media roll-to-roll arrangement 350 for use as part of an example image formation device. In some examples, media roll-to-roll arrangement 350 comprises a media supply 352 on which is wound a supply of media 355. Media 355 may comprise one example implementation of a substrate (e.g. 24 in FIGS. 1A, 3). Via an array 356 of rollers 357A, 357B, supports, gears, and/or drives, the media roll-to-roll arrangement 350 provides and directs a media 355 to pass as substrate 24 along travel path T to pass by various portions, charge sources, elements, etc. (e.g. 30, 50, etc. in FIGS. 1A, 3) of an image formation device. Via such an arrangement, media 355 may act as a substrate without a separate, additional support along the length of media 355. In some examples, the media roll-to-roll arrangement may comprise one example implementation of movement element 80 previously described in association with at least FIG. 1B.

Figure 6A:
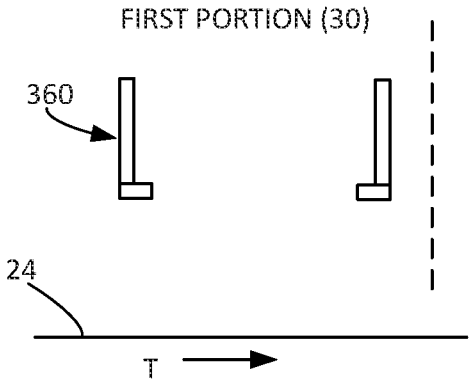
FIG. 6A is a diagram schematically representing an example portion to removably receive an example fluid ejection device, while FIG. 6B schematically represents removably insertion of the example fluid ejection device into the portion.
Figure 6B:
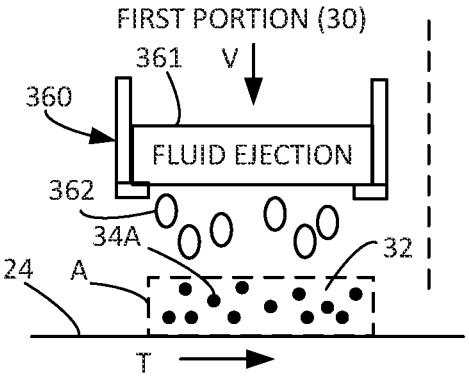

As further shown in FIG. 6A, in some examples the first portion 30 of an example image formation device (e.g. 10, 200 in FIGS. 1A, 3) may comprise a receiving portion 360 to removably receive a fluid ejection device 361, such as in some examples in which the fluid ejection device 361 is removably insertable into the receiving portion 360. The receiving portion 360 is sized, shaped, and positioned relative to substrate 24, as well as relative to other components of the image formation device (e.g. 10, 200) such that upon removable insertion relative to receiving portion 360 (as represented by arrow V in FIG. 6B), the fluid ejection device 361 is positioned to deliver (e.g. eject) the droplets 362 of ink particles 34A and dielectric carrier fluid 32 onto substrate 24, as shown in FIG. 6B. In some such examples, the fluid ejection device 361 may comprise a consumable which is periodically replaceable due to wear, exhaustion of an ink supply, etc. In some such examples, the fluid ejection device 361 may be sold, supplied, shipped, etc. separately from the rest of image formation device (e.g. 10, 200, etc.) and then installed into the image formation device upon preparation for use of the image formation device at a particular location.

In some examples, the fluid ejection device 361 may comprise an inkjet printhead. In some such examples, the fluid ejection device 361 may comprise a piezoelectric inkjet printhead, a thermal inkjet printhead, etc.

In some examples, as part of ejecting droplets (e.g. 362 in FIGS. 6B, 7), the fluid ejection device 361 is to deposit the dielectric carrier fluid 32 (with ink particles therein) on the substrate 24 as a non-aqueous liquid. In some examples, the non-aqueous liquid comprises an isoparrafinic fluid, which may be sold under the trade name ISOPAR™ by ExxonMobil™. In some such examples, the non-aqueous dielectric liquid may comprise other oil-based liquids suitable for use as a dielectric carrier fluid.

Figure 7:
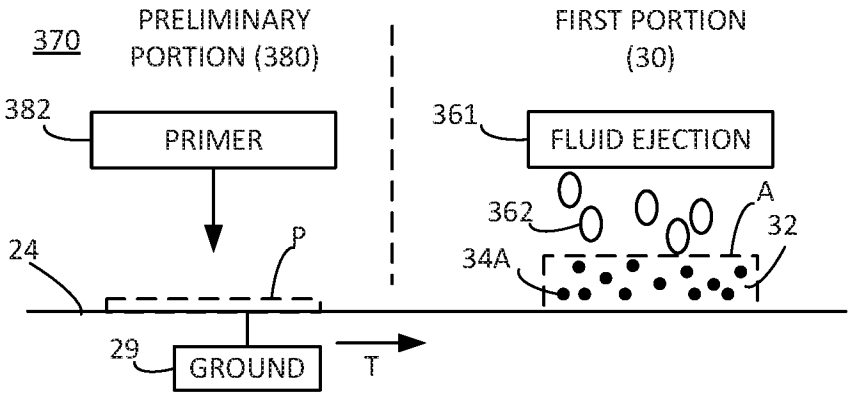
FIG. 7 is a diagram schematically representing an example preliminary portion upstream from an example first portion of a device and/or example portion of a method of image formation.

FIG. 7 is a diagram including a side view schematically representing an example image formation device 370 and/or example method. In some examples, the example image formation device 370 comprises at least some of substantially the same features as at least example image formation devices 10, 200, etc. (FIGS. 1A-4D), including the previously-described, polarity-switching-based, electrostatic fixation of ink particles 34 relative to substrate 24.

However, in the example image formation device 370 in FIG. 7, a preliminary portion 380 precedes the first portion 30. The preliminary portion 380 is located upstream from (e.g. precedes) the first portion 30 and comprises a primer element 382 to deposit a primer layer on substrate 24, as represented via dashed box P. In some examples, the primer layer P comprises material(s) which prepare the surface of substrate 24 to receive droplets of ink particles 34A within the carrier fluid 32 in the first portion 30. In some examples, the primer material (P) may facilitate polarity-switching-based electrostatic fixation (EF) of the ink particles 34A relative to the substrate 24. Some example primer materials may comprise a resin particles, dissolved resin, binding polymers, and/or adhesion promoting materials.

Figure 8B:
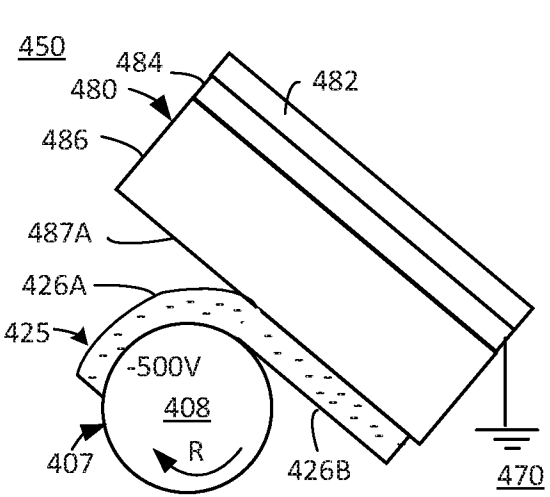
FIGS. 8A and 8B are each a diagram including a side view schematically representing an example transfer member and an example developer unit of an example image formation device and/or example method of image formation.
Figure 8A:
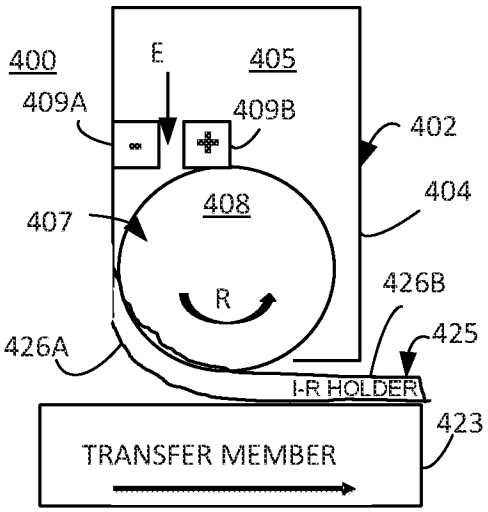
Figure 8C:
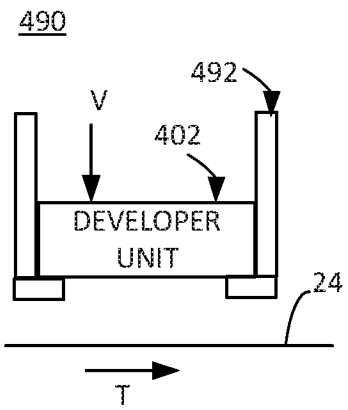
FIG. 8C is a diagram including a side view schematically representing an example developer unit removably inserted into an example receiving portion and/or at least some aspects of an example method of image formation.

In some examples, a preliminary portion 380 of an example image formation device (e.g. 370 in FIG. 7) may comprise a developer unit 402, as shown in FIGS. 8A-8C, to develop and apply an image-receiving holder layer 425 onto a transfer member 423. In such examples, the image-receiving holder layer 425 (supported by transfer member 423) may be considered one example implementation of substrate 24.

FIG. 8A provides a diagram 400 schematically representing one example developer unit 402. In some examples, the developer unit 402 may comprise at least some of substantially the same features and attributes as a developer unit as would be implemented in a liquid electrophotographic (LEP) printer, such as but not limited to, an Indigo brand liquid electrophotographic printer sold by HP, Inc. In some examples, the developer unit may comprise a binary developer (BID) unit. In some examples, the developer unit 402 may comprise at least some of the features of a binary developer (BID) unit as described in Nelson et al. US20180231922.

As shown in FIG. 8A, in some examples, the developer unit 402 comprises a container 404 for holding various materials 405 (e.g. liquids and/or solids) from which a formulation is developed into semi-liquid, image-receiving holder layer 425. The materials 405 may comprise binding materials, such as resin particles, dissolved resin, binding polymers (dissolved or as resins), or adhesion promoting materials, as well as materials such as (but not limited to) dispersants, charge directors, mineral oils, foam depressing agents, UV absorbers, cross linking initiators and components, heavy oils, blanket release promoters, and/or scratch resistance additives. In one aspect, the materials 405 in any given formulation of the image-receiving holder layer 425 are combined in a manner such that materials 405 will be flowable in order to enable formation of the image-receiving holder as a layer 425 on transfer member 423. In some examples, a mineral oil portion of the materials 405 may be more than 50 percent by weight of all the materials 405. In some such examples, the mineral oil portion may comprise an isoparrafinic fluid. In some examples, the binding materials may facilitate the polarity-switching-based electrostatic force fixation of the ink particles 34A (e.g. FIGS. 1A, 2) relative to the image-receiving holder layer 425.

In some examples, the container 404 may comprise individual reservoirs, valves, inlets, outlets, etc. for separately holding at least some of the materials 405 and then mixing them into a desired paste material to form an image-receiving holder as layer 425. In some examples, the developed paste may comprise at least about 20 percent to about 30 percent solids, which may comprise resin or binder components and may comprise at least charge director additives along with the binder materials. In some examples, the solids and charge director additives are provided within a dielectric carrier fluid, such a non-aqueous fluid, such as but not limited to the above-described isoparrafinic fluid. In some examples, solid particles within the paste have a largest dimension (e.g. length, diameter) on the order of about 1 or about 2 microns.

As further shown in FIG. 8A, the developer unit 402 comprises a roller assembly 407 disposed at least partially within container 404 and selectively exposed to the formulated paste used to form image-receiving holder layer 425. In some examples, the transfer member 423 may be implemented as transfer member 480 as shown in the diagram 450 of FIG. 8B.

In some examples, the roller assembly 407 in FIGS. 8A-8B may comprises a developer drum 408 (or roller), which is driven to a negative voltage (e.g. −500 V) for electrostatically charging the paste and electrostatically delivering the charged paste as image-receiving holder layer 425 on the transfer member 423, 480, as shown in FIGS. 8A-8B. In one such example, the paste of materials 405 is negatively charged. In some examples, the charge director additives receive and hold the negative charge in a manner to thereby negatively charge at least the binder materials within the paste of materials 405 when an electrical field is applied to the paste of materials 405, such as via the development roller 408 at −500 Volts. Via such example arrangements, the image-receiving holder layer 425 may sometimes be referred to as an electrically charged, image-receiving holder layer.

In some examples, the developer drum or roller 408 may comprise a conductive polymer, such as but not limited to polyurethane or may comprise a metal material, such as but not limited to, Aluminum or stainless steel.

In some examples, the materials 405 may start out within the container 404 (among various reservoirs, supplies) with about 3 percent solids among various liquids, and via a combination of electrodes (e.g. at least 409A, 409B in FIG. 8A) "squeeze" the formulation into a paste of at least about 20 percent solids, as noted above. As shown in at least FIG. 8B, the paste of materials 405 is applied as a layer (onto transfer member 480) having a thickness of about 4 to about 8 microns, in at least some examples. It will be understood that the volume and/or thickness of the electrically charged, semi-liquid layer (forming image-receiving holder 425) that is transferred from the developer unit 402 to the transfer member 423 may be controlled based on a voltage (e.g. −500V) of the developer roller 408 and/or a charge level of the solid particles within the paste produced by the developer unit 402.

In some examples, as further described later in association with at least FIG. 12A, among directing other and/or additional operations, a control portion 1000 is instruct, or to cause, the developer unit 402 to apply the electrically charged, semi-liquid image-receiving holder layer 425 onto transfer member 23, such as within the preliminary portion 380 along the travel path T.

Upon rotation of at least drum 408 of the roller assembly 407, and other manipulations associated with container 405, the drum 408 electrostatically attracts some of the charged developed material to form image-receiving holder layer 425, which is then deposited onto transfer member 423 as shown in FIGS. 8A-8B.

During such coating, the image-receiving holder layer 425 becomes electrostatically releasably fixed relative to the transfer member 423. In this arrangement, a first surface 426A (i.e. side) of the image-receiving holder layer 425 faces the transfer member 423 while an opposite second surface 426B of the image-receiving holder layer 425 faces away from transfer member 423.

In some examples the transfer member 423 may comprise a transfer member 480. In some such examples, the transfer member 480 comprises an outer layer 486, an electrically conductive layer 484, and a backing layer 482. In some examples, the transfer member 480 comprises at least some electrically conductive material (e.g. layer 484) which may facilitate attracting the negatively charged paste to complete formation of image-receiving holder layer 425 on a surface 487A of an outer layer 486, as shown in FIG. 8B.

In some such examples, the outer layer 486 of transfer member 480 may comprise a layer which is compliant at least with respect to a particular media onto which the formed image will be transferred. In some examples, the outer layer 486 may comprise a silicone rubber layer and is made of a flexible, resilient material. In some such examples, the electrical conductivity of outer layer 486 may be in the range of about $10^4$ Ohm-cm to about $10^7$ Ohm-cm, although in some examples, the electrical conductivity may extend outside this range. The electrical properties of layer 486 can be optimized with regards to voltage drop, charge conductivity across the layer, response time, and arcing risks.

In some examples, the electrically conductive layer 484 of transfer member 480 may comprise of a conductive rubber like silicone, a conductive plastic like polyvinyl chloride (PVC), or a polycarbonate which typically is doped with carbon pigments to become conductive. In some examples, the electrically conductive layer 484 may comprise other conductive inks, adhesives, or curable conductive paste could also be used as well as metalized layer. In some examples, the electrically conductive layer 484 may comprise a sheet resistance of less than 100 ohm/sq and be made from materials which are more conductive than 0.1 Ohm-cm.

As shown in FIG. 8B, in some examples the electrically conductive layer 484 is electrically connected to an electrical ground 470.

In some examples, the backing layer 482 may comprise a fabric, polyamide material, and the like in order to provide some stiffness to the transfer member 480, among other functions. In some examples, the outer layer 486 may comprise a thickness of about 100 microns while the electrically conductive layer 484 may comprise a thickness on the order of a few microns. In some examples, an overall thickness of the transfer member may be on the order of 100 microns.

In some examples, the transfer member 480 may comprise a release layer of a few microns thickness on top of the outer layer 486 in order to facilitate selective release of image-receiving holder layer 425 from the transfer member 480 at a later point in time, such as at a transfer station to transfer image-receiving holder layer 425 (with ink particles 34A thereon) onto an image formation medium.

In some examples, the developer unit 402 may comprise a permanent component of an image formation device (e.g. 10, 200, etc.) with the developer unit 402 being sold, shipped, and/or supplied, etc. as part of image formation device (e.g. 10, 200, etc.). It will be understood that such "permanent" components may be removed for repair, upgrade, etc. as appropriate.

As shown in FIG. 8C, in some examples an image formation device (e.g. 10, 200, etc.) may comprise a receiving portion 492 like receiving portion 360 in FIGS. 6A-6B, except to removably receive the developer unit 402 instead of receiving a fluid ejection device 361. Accordingly, in some examples the developer unit 402 is removably insertable into the receiving portion 492, as shown in at least FIG. 8C. In some such examples, the receiving portion 492 is sized, shaped, and positioned relative to transfer member (e.g. 423, 480 in FIGS. 8A, 9A), as well as relative to other components of image formation device (e.g. 10, 200, etc.), such that upon removable insertion into to receiving portion 492 (as represented by arrow V in FIG. 8C), the developer unit 402 is positioned to deliver the image-receiving holder layer 425 onto transfer member 423, 480 (FIGS. 8A-8B, 9A) or other substrate 24 (e.g. FIGS. 1A, 2).

In some examples, the developer unit 402 may comprise a consumable which is periodically replaceable due to wear, exhaustion of a supply of materials, developer components, etc. In some such examples, the developer unit 402 may be sold, supplied, shipped, etc. separately from the rest of an image formation device (e.g. 10, 200, etc.) and then installed into the respective image formation device (e.g. 10, 200, etc.) upon preparation for use of the image formation device at a particular location. Accordingly, it will be apparent that in some examples the receiving portion 492 may comprise part of the preliminary portion 380 of the example image formation device in FIG. 7 or image formation device 500 in FIG. 9A or a preliminary portion (when applicable) of another one of the example image formation devices described in the present disclosure.

Figures 9A, 9B:
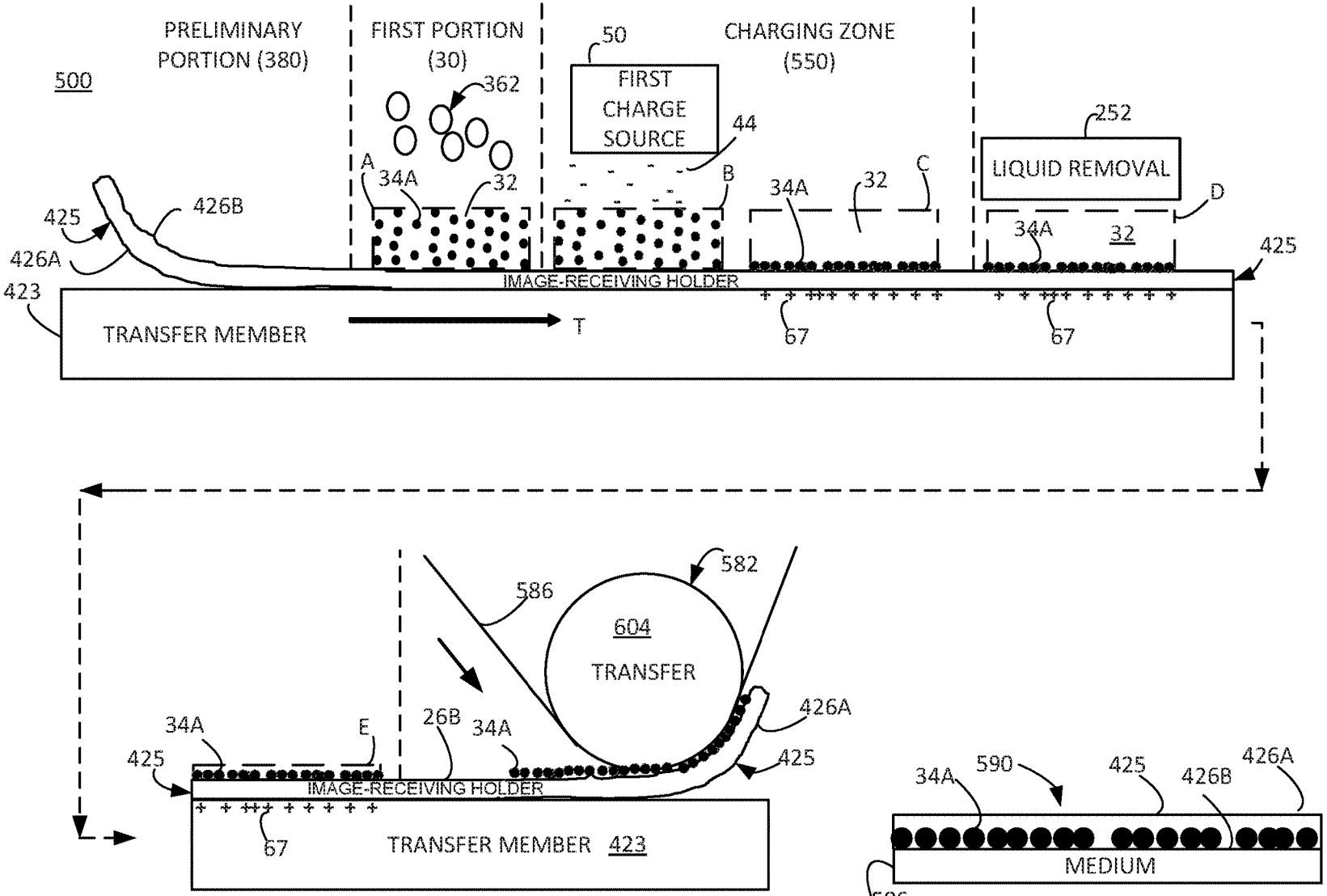
FIG. 9A is a diagram including a side view schematically representing an example image formation device and/or example method of image formation.
FIG. 9B is a diagram including a side view schematically representing an example image formation medium assembly.

When the developer unit 402 is present, in some examples its operation may comprise developing the image-receiving holder layer 425 without any color pigments in the image-receiving holder layer 425, such that the image-receiving holder layer 425 may sometimes be referred to as being colorless. In this arrangement, the image-receiving holder layer 25 corresponds to a liquid-based ink formulation which comprises at least some of substantially the same components as used in liquid electrophotographic (LEP) process, except for omitting the color pigments. In addition to being colorless in some examples, the material used to form the image-receiving holder layer also may be transparent and/or translucent upon application to an image formation medium or to a transfer member 423, 480 (FIGS. 8A-8B, 9A).

In at least some examples in which the image-receiving holder layer 425 omits color pigments, the materials of the image-receiving holder layer 425 effectively do not comprise part of the image resulting from the deposited color ink particles which will be later transferred (with the image-receiving holder layer 425) onto an image formation medium. Accordingly, in some such examples the image-receiving holder layer 425 also may sometimes be referred to as a non-imaging, image-receiving holder layer 425.

In some such examples, the image-receiving holder layer 425 comprises all (e.g. 100 percent) of the binder used to form an image (including ink particles 34A) on transfer member 423 (and later on an image formation medium). In some such examples, image-receiving holder layer 425 comprises at least substantially all (e.g. substantially the entire volume) of the binder used to form the image (including ink particles). In some such examples, in this context the term "at least substantially all" (or at least substantially the entire) comprises at least 95%. In some such examples "at least substantially all" (or at least substantially the entire) comprises at least 98%. In some examples in which the image-receiving holder layer 425 may comprise less than 100 percent of the binder used to form the image on the transfer member 423 (and later on an image formation medium), the remaining desired amount of binder may form part of droplets 362 delivered in the first portion 30 of an image formation device (e.g. 10, 200, etc.). It will be understood that the term binder may encompass resin, binder materials, and/or polymers, and the like to complete image formation with the ink particles (e.g. 34A, etc.). In some examples, a mineral oil portion of the materials 405 (which includes the binder) may be more than 50 percent by weight of all the materials 405.

As further noted below, formulating the image-receiving holder layer 425 to comprise at least substantially all of the binder material(s) to be used to form an image on the transfer member 423, 480 (and later on an image formation medium) acts to free the first portion 30 (and fluid ejection device 70) so that, in at least some examples, the droplets (e.g. 362 in FIGS. 6B, 7) may omit any binder material, and therefore be "binder-free." Accordingly, in some examples, the droplets 362 may sometimes be referred to as being binder-free droplets. In some examples, the droplets 362 may include a small amount of binder material (e.g. 1, 2, 3, etc. percent) and therefore may sometimes be referred to being substantially binder-free droplets 362.

In some examples, the droplets 362 omit charge director additives and therefore may sometimes be referred to as being charge-director-free. In some such examples, the image-receiving holder layer 425 may comprise some charge-director additives as further described with respect to developer unit 402 (FIGS. 8A-8B).

This example arrangement of supplying all or substantially all of the binder (for forming the image) via the image-receiving holder layer 425 may help to operate a fluid ejection device (e.g. 361 in FIGS. 6B, 7) with fewer maintenance issues because the absence (or nearly complete absence) of a binder in the droplets 362 may avoid fouling the ejection elements, which may sometimes occur with droplets 362 including binder material for forming an image on an image formation medium. In addition to simplifying maintenance, this arrangement may increase a longevity of the ejection elements (e.g. printhead) of the fluid ejection device.

In some examples, the developer unit 402 is to apply the image-receiving holder layer 425 in a volume to cover at least substantially the entire surface of the transfer member 423, 480 in at least the area in which the image is be formed on transfer member 423, 480 and immediately surrounding regions. In some examples, in this context, the term "substantially the entire" comprises at least 95 percent, while in some examples, the term "substantially the entire" comprises at least 99 percent.

In some examples, the image-receiving holder layer 425 is applied to form a uniform layer covering an entire surface of the transfer member 423, 480 (at least including the area in which an image is to be formed). This arrangement stands in sharp contrast to some liquid electrophotographic printers in which liquid ink (with color pigments) is applied just to areas of a charged photo imaging plate (PIP), which have been discharged in a pattern according to the image to be formed. According, the application of a uniform layer (covering an entire surface of the transfer member 423, 480) of the image-receiving holder layer 425 in the example image formation device (e.g. in FIGS. 8A-8B, 9A-9B) bears no particular relationship to the pattern of an image to be formed on the image-receiving holder layer 425. Therefore, in some instances, the image-receiving holder layer 425 may sometimes be referred to as a non-imaging, image-receiving holder layer 425.

Moreover, in another aspect, coating image-receiving holder layer 425 on transfer member 423 may effectively eliminate "image memory" which otherwise may sometimes occur when forming ink images directly on a transfer member. In one aspect, this elimination of "image memory" is achieved because the image-receiving holder layer 425 comprises a significantly high proportion of solids.

In addition, the coating of image-receiving holder layer 425 on the transfer member 423 may protect the transfer member 423, 480 from dust from an image formation medium (e.g. paper dust) and/or from plasma associated with production of charges (e.g. 52, 72, 210, etc.) via a charge source (e.g. 50, 70, 210, etc.) as further described later, and/or from any pigments or ink particles 34A which might otherwise become stuck on the transfer member 423 in the absence of the image-receiving holder layer 425. Among other aspects, this arrangement may increase a longevity of the transfer member 423, 480. In some examples, the employment of the image-receiving holder layer 425 to receive and transfer an image (made of ink particles 34) may substantially increase the longevity of the transfer member 423, 480. In some examples, in this context the term "substantially increase" may correspond to an increase in longevity of at least 25%, at least 50%, or at least 75%. In some examples, in this context the term "substantially increase" may correspond to an increase in longevity of at least 2×, at least 3×, or at least 5×.

FIG. 9A is a diagram including a side view schematically representing an example image formation device 500. It will be further understood that FIG. 9A also may be viewed as schematically representing at least some aspects of an example method of image formation.

In some examples, the image formation device 500 comprises at least some of substantially the same features and attributes as the previously described example image formation devices (e.g. 10, 200) in FIGS. 1A-8C.

As shown in FIG. 9A, in some examples the image formation device 500 comprises a transfer member 423, a preliminary portion 380, a first portion 30, charge source 50, liquid removal element 252. Operation of the image formation device 500 results in a printed medium assembly 590 as shown in FIG. 9B and which comprises an image-receiving holder layer 425 covering and bonding an image formed via ink particles 34A on an image formation medium 586. In some examples, the preliminary portion 380 and/or at least first portion, first charge source, etc. (e.g. 30, 50, etc.) comprise at least some of substantially the same features and attributes as previously described in association with at least FIGS. 1A-8C. In some examples, the substrate 424 is implemented as a transfer member 423 which supports an image-receiving holder layer 425 having substantially the same features and attributes as image-receiving holder layer 425 described in association with FIGS. 8A-8C.

As further shown in FIG. 9A, in some examples the preliminary portion 380 of image formation device 500 is to receive a coating of material on the transfer member 423 to form an image-receiving holder layer 425 in a manner substantially the same as described in association with at least FIGS. 8A-8B.

In some examples, transfer member 423 may implemented on, or as part of, an endless belt or web (e.g. 711 in FIG. 10A) while in some examples transfer member 423 may be implemented on, or as part of, a rotating drum. When implemented as an endless belt or web, it will be understood that the transfer member 423 may be moved along travel path T via support from an array of rollers (e.g. 710 in FIG. 10A), tensioners, and related mechanisms to maintain tension and provide direction to transfer member 423 along travel path T.

As shown in FIG. 9A, the transfer member 423 moves along a travel path T. In some examples, the transfer member 423 comprises an electrically conductive member, among other layers. In some examples, the transfer member may be referred to as a blanket. In some examples, the electrically conductive portion of the transfer member 423 may be in contact with an electrically conductive ground element such as a brush, roller or plate in rolling or slidable contact, respectively, with a portion of the transfer member 423. In some examples, a ground element (e.g. 29 in FIG. 7) is in contact with an edge or end of the transfer member 423. At least one example implementation of the transfer member 423 is described as transfer member 480 in FIG. 8B.

In a manner consistent with the previously-described example image formation devices, polarity-based-switching electrostatic fixation (EF) of ink particles 34A is implemented relative to the image-receiving holder layer 425, thereby ensuring that the ink particles 34A remain in their targeted locations to form an image. In one aspect, the polarity-switching-based electrostatic fixation (EF) occurs relative to the charged binder material in the image-receiving holder layer 425. Accordingly, while the EF arrows are omitted in FIG. 9A for illustrative simplicity, it will be understood that such electrostatic forces (EF) are present in the charging zone 550, and portions downstream from the charging zone, of the image formation device 500 as previously described in association with at least FIGS. 1A-8C.

With this in mind, in a manner similar to that previously described for at least example image formation devices 10, 200 (FIGS. 1A-4D), the various portions, charge sources, etc. (e.g. 30, 50, etc.) of example image formation device 500 are to operate as previously described in association with FIGS. 1A-8C to form an image on image-receiving holder 425, including the use of the previously described polarity-switching-based electrostatic fixation of ink particles 34A relative to a substrate. In particular, via the charging zone 550, a number of charge sources are arranged along a travel path T to ensure the deposited ink particles remain securely on the substrate (e.g. image-receiving holder 425) in the intended pattern until the ink particles are to be transferred onto an image formation medium.

As further shown in FIG. 9A, in some examples image formation device 500 may further comprise a transfer station 582 downstream from at least the liquid removal element 252. Via at least a transfer roller (e.g. drum) 604 the transfer station 582 is to transfer at least substantially the entire image-receiving holder layer 425 with at least substantially the entire volume of ink particles 34A thereon (in the form of an image) onto an image formation medium 586. As previously noted, this complete (or nearly complete transfer) may increase image quality, protect the transfer member, etc. In addition, in this way, no residue is left remaining on the transfer member 423, 480, thereby simplifying or eliminating later cleaning of the transfer member 423, 480, such as between consecutive printing episodes.

In some examples, the transfer station 582 may employ heat, pressure, and/or electrical bias, etc. in order to effect the above-described transfer.

In addition, by transferring the image-receiving holder layer 425 with the ink particles 34A (as a pattern or form of an image), the image-receiving holder layer 425 becomes an outermost layer of a completed image formation medium assembly 590 shown in FIG. 9B, thereby protecting the image formed of ink particles 34A and helping bond the formed image to the image formation medium 586.

In some examples, the image-receiving holder layer 425 may sometimes be referred to as an image receiver or an image holder. In some examples, the image-receiving holder layer 425 may sometimes be referred to as an initial image formation medium (i.e. initial print medium) because the image is formed on, and remains on, the image-receiving holder layer 425. Meanwhile, the "medium" (e.g. 586 in FIGS. 9A-9B) to which the ink particles and the image-receiving holder layer 425 are transferred together (via a transfer station) may sometimes be referred to as a second image formation medium (i.e. second print medium) or a final image formation medium (i.e. final print medium). In some examples, the initial image formation medium (e.g. 425 in FIG. 9A) and the final image formation medium (e.g. 586 in FIG. 9B) may sometimes be referred to as a first image formation medium and a second image formation medium, respectively. In some such examples, the second or final image formation medium is part of an image formation medium assembly (e.g. 590 in FIG. 9B) in which the image made of a pattern(s) of ink particles 34A are at least partially sandwiched between the initial (or first) image formation medium 425 (e.g. image-receiving holder layer) and the final (or second) image formation medium 586. In some such examples, the image formed of a pattern(s) of ink particles 34A becomes at least partially sandwiched between the first and second image formation mediums with some portions of the respective first and second image formation mediums (e.g. 425, 586) being in direct contact with each other, as shown in FIG. 9B in one example.

In some examples, the second image formation medium may sometimes be referred to as a cover layer or outer layer relative to the ink particles and relative to the first image formation medium (i.e. image-receiving holder).

In some examples, the image-receiving holder may sometimes be referred to as an image-receiving medium. In some examples, the semi-liquid image-receiving holder may sometimes be referred to as a paste, a semi-liquid base, semi-solid base, or base layer.

In transferring all or substantially all of the ink particles 34A (from their supported position relative to transfer member 423) onto an image formation medium 586, the image-receiving holder layer 425 facilitates additional forms of printing, i.e. image formation. In particular, because all of the ink particles 34A can be transferred, the fluid ejection device (e.g. 361 in FIGS. 6B, 9A) (via instructions from control portion 1000) can perform stochastic-screening image formation via ink particles in which dot sizes (made of ink particles 34A) used to form an image may be less than 50 microns on the image-receiving holder layer 425 (supported by the transfer member 423). In some such examples, the dot sizes formed on the image-receiving holder layer 425 may be about 40 microns or less than 40 microns, may be about 30 microns or less, etc. In some such examples, the dot sizes formed on the image-receiving holder layer 425 may be about 20 microns or less. It will be understood that in some examples the ink particles 34A may have a largest dimension (e.g. diameter, length, etc.) less than about 1 micron.

Figure 10A:
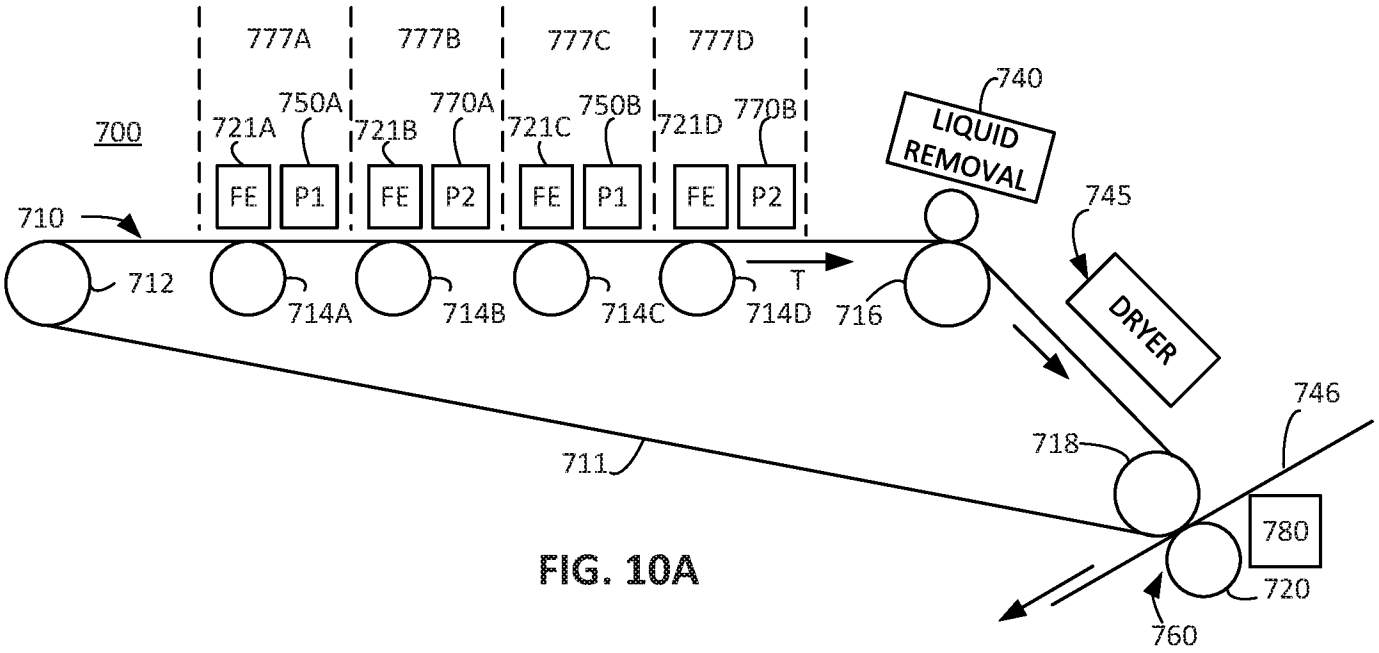
FIG. 10A is a diagram including a side view schematically representing an example image formation device and/or example method of image formation.

FIG. 10A is a diagram including a side view schematically representing at least a portion of an example image formation device 700. In some examples, image formation device 700 comprises at least some of substantially the same features as the image formation devices as previously described in association with FIGS. 1A-9B. Accordingly, the example image formation device 700 comprises a single charge source or multiple charge sources to alternate (e.g. switch) a polarity of charges applied to ink particles for electrostatic fixation to a substrate, such as web 711 which is further described below. In some examples, the single charge source or multiple charge sources of image formation device 700 may be arranged as in one of the example implementations previously described in association with at least FIGS. 1A-4D. In some such examples, as shown in FIG. 10A, device 700 comprises a series of portions 777A, 777B, 777C, 777D to deposit a multi-color image onto web 711, as further described below.

In some examples, image formation device 700 comprises a substrate arranged in the form of, or as part of, an endless belt or web 711 and with the various portions 777A, 777B, 777C, 740, 745, etc. of image formation device 700 arranged in a pattern along belt 711 which travels in an endless loop, as shown in FIG. 10A. In some examples, transfer belt 711 forms part of a belt assembly 710 including various rollers 712, 714A, 714B, 714C, 714D, 716, 718, 720, etc. and related mechanisms to guide and support travel of belt 711 along travel path T and through the various portions along travel path T of image formation device 700. In some examples, each of the rollers 714A-D may be positioned (e.g. elevated enough) to exert tension on belt 711. It will be understood that in some examples belt 711 may comprise a transfer member (e.g. 423, 480 in FIGS. 8A-8B, 9A).

While not shown for illustrative simplicity, it will be understood that in some examples the image formation device 700 may comprise a preliminary portion (e.g. 380 in FIG. 7) to receive a primer layer or a developer unit (e.g. 402 in FIGS. 8A-8B) to deposit an image-holding layer (e.g. 425). In such examples, the preliminary portion or developer unit is located upstream from first portion 777A.

In a manner similar to that previously described for at least some example image formation devices (e.g. 10, 200 in FIGS. 1A, 2), the various portions 777A, 777B, 777C, 777D of example image formation device 700 are to operate as previously described in association with FIGS. 1A-9B to form an image on an image formation medium 746, including the use of the previously described polarity-switching-based electrostatic fixation of ink particles 34A relative to a substrate. In particular, via the portions 777A, 777B, 777C, 777D, a number of charge sources are arranged along a travel path T of web 711 to ensure the deposited ink particles remain securely on the substrate in the intended pattern until the ink particles are to be transferred onto an image formation medium.

As shown in FIG. 10A, in some examples device 700 comprises a first color image formation portion 777A along travel path T, with portion 777A comprising a fluid ejection (FE) portion 721A to receive and/or deposit droplets of first color ink particles (within a carrier fluid) in the pattern of an image on web 711 (or other substrate) and a first polarity (P1) charge source 750A to charge the deposited ink particles (e.g. 34A) with first polarity charges (e.g. 52 in FIG. 1A) to electrostatically fix (e.g. pin) the charged first color ink particles relative to the substrate (e.g. web 711) in the pattern of the image. Meanwhile, a second color image formation portion 777B is downstream from portion 777A along the travel path T, and comprises a fluid ejection portion 721B to receive and/or deposit droplets of different second color ink particles (within a carrier fluid) to further form the image and comprises an opposite second polarity (P2) charge source 770A to charge the deposited first and second color ink particles with the opposite second polarity charges (e.g. 72 in FIG. 1A) to electrostatically fix the charged first and second color ink particles relative to the substrate (e.g. web 711) in the pattern of the image.

In some examples, device 700 may comprise a third color image formation portion 777C downstream from portion 777B along the travel path T. Portion 777C may comprise a fluid ejection portion 721C to receive and/or deposit droplets of different third color ink particles (within a carrier fluid) to further form the image on the substrate and comprises a first polarity (P1) charge source 770B to charge the deposited first, second, and third color ink particles with the first polarity charges (e.g. 52 in FIG. 1A) to electrostatically fix the charged first, second, and third color ink particles relative to the substrate (e.g. web 711) in the pattern of the image.

In some examples, device 700 may comprise a fourth color image formation portion 777D downstream from portion 777C along the travel path T. Portion 777D may comprise a fluid ejection portion 721D to receive and/or deposit droplets of different fourth color ink particles (within a carrier fluid) to further form the image and comprises an opposite second polarity (P2) charge source 770B to charge the deposited first, second, third, and fourth color ink particles with the first polarity charges (e.g. 52 in FIG. 1A) to electrostatically fix (e.g. pin) the respectively different multiple color ink particles in their deposited pattern relative to the substrate (e.g. web 711) to form the desired image.

In some examples, the example image formation device 700 comprises a first liquid removal portion 740 located downstream along travel path T from the portions 777A, 777B, etc. In some examples, the first liquid removal portion 740 may comprise an element(s) to mechanically remove at least a portion of the carrier fluid from the substrate, which may comprise web 711, an image-receiving holder 425, or other type of substrate etc. The element(s) may comprise a squeegee, roller, air blade, and the like to mechanically separate and remove the excess carrier fluid without disturbing the ink particles as electrostatically fixated relative to the substrate.

In some examples, the example image formation device 700 comprises a second liquid removal portion 745 located downstream from the first liquid removal portion 740. In some such examples, the second liquid removal portion 745 may comprise a heated air element to direct heated air onto any remaining carrier fluid, liquids, etc. or may comprise a radiation device to direct at least one of IR radiation and UV radiation onto the remaining carrier fluids, liquids, etc. After operation of the second liquid removal portion 745, the electrostatically fixed ink particles are ready for transfer to an image formation medium. As shown in FIG. 10A, in some instances the second liquid removal portion 745 may sometimes be referred to as a dryer.

It will be understood that elements such as the first and second liquid removal portions 740, 745 may form part of an image formation device in which the substrate is implemented as a media roll-to-roll arrangement (e.g. FIG. 5) such that the respective liquid removal portions 740, 745 are located along the travel path T of the media (e.g. 355 in FIG. 5) and downstream from the last charge source(s) of the image formation device.

As further shown in FIG. 10A, in some examples the image formation device 700 comprise a portion 780, which may comprise a transfer station 760 comprising at least some of substantially the same features and attributes as the previously described transfer station (e.g. 582 in FIG. 9A). In some instances, the roller 720 may serve as, or be referred to, as an impression cylinder. Via interaction of roller 718 and impression cylinder 720, the image-patterned ink particles are transferred onto medium 746.

Figure 10B:
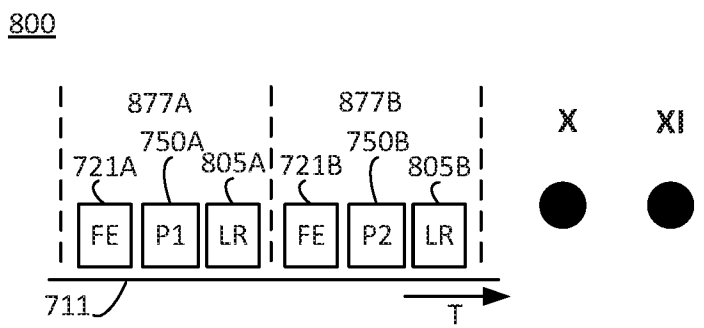
FIG. 10B is a diagram schematically representing a portion of an example image formation device and/or example method of image formation.

As further shown in FIG. 10B, in some examples an example image formation device 800 may comprise a device like device 700 except further comprising the addition of a liquid removal (LR) element 805A located after the first charge source 750A within portion 877A in order to remove excess liquid (e.g. supernatant liquid) prior to deposit of additional ink droplets (comprising at least ink particles and carrier fluid) via second fluid ejection (FE) portion 721B. The liquid removal (LR) element 805A may comprise at least some of substantially the same features and attributes as liquid removal element 252 in FIG. 9A and/or liquid removal element 740 in FIG. 10A. Similarly, a second liquid removal (LR) element 805B may be located after the second charge source 750B within portion 877B. As represented via black circles X and XI, device 800 may comprise additional portions like portions 777C, 777D in FIG. 10A except further comprising a liquid removal element like LR elements 805A, 805B of portions 877A, 877B in FIG. 10B.

It will be understood that in some examples, upon the inclusion of elements like the liquid removal (LR) elements (e.g. 805A, 805B, etc.) shown in the example device 800 of FIG. 10B, the liquid removal element 740 in FIG. 10A may be omitted. However, in some examples, liquid removal element 740 (FIG. 10A) may comprise part of device 800 in the location shown in FIG. 10A despite the addition of some or all of the liquid removal (LR) elements (e.g. 805A, 805B, etc.) after each respective charge source (e.g. 750A, 750B, etc.) as shown in FIG. 10B.

In some examples, in a manner similar to that shown in FIG. 10B, liquid removal elements (e.g. 805A, 805B, etc.) may be introduced into other example devices (e.g. 10 in FIG. 1A) along a travel path T after a charge source (e.g. 50 in FIG. 1A) and before a subsequent fluid ejection portion (e.g. 60 in FIG. 1A). Similarly, a liquid removal element (e.g. 805A) may be introduced into other example devices (e.g. 200 in FIG. 3) along a travel path T after a first charge source (e.g. 50 in FIG. 3) and before a second charge source (e.g. 70 in FIG. 3) and/or introduced between second and third charge sources (e.g. 70 and 210 in FIG. 3).

Figure 11:
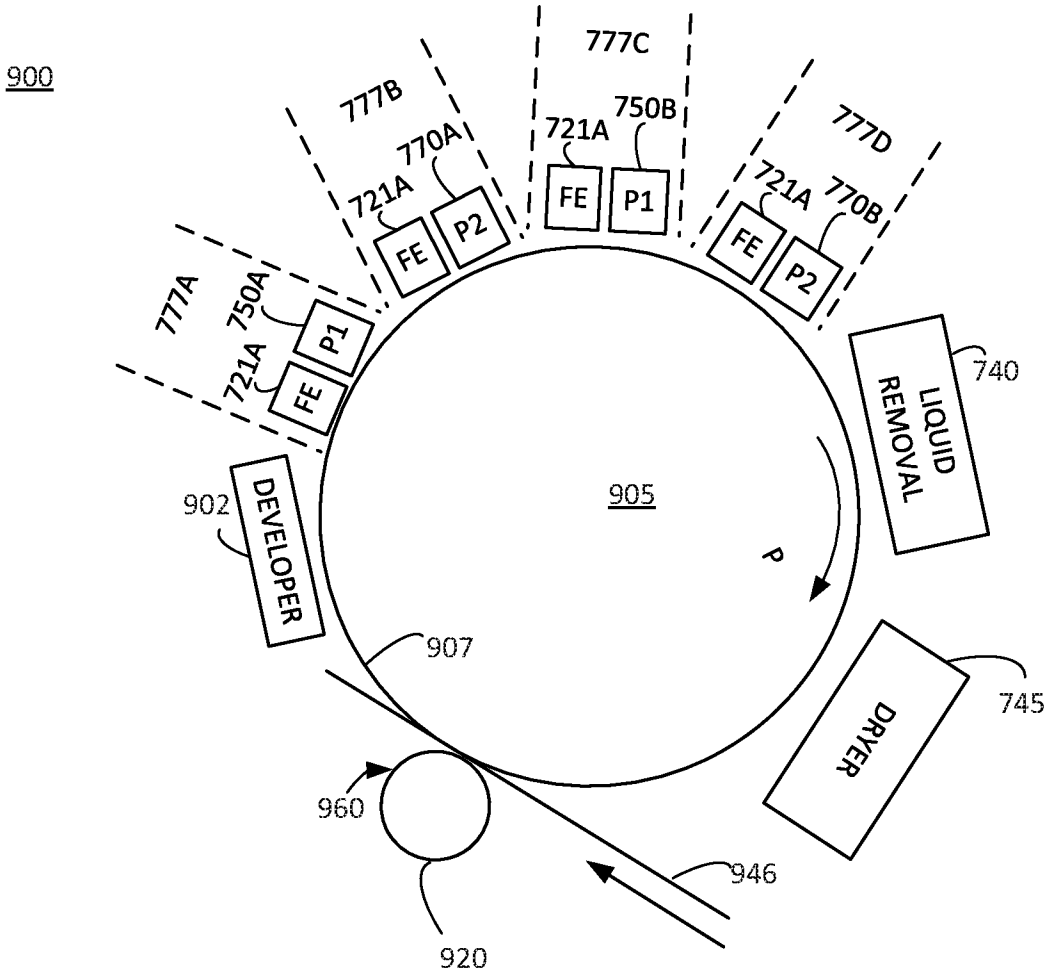
FIG. 11 is a diagram schematically representing an example image formation device and/or example method of image formation.

FIG. 11 is diagram including side view schematically representing an example image formation device 900 and/or example image formation method. In some examples, device 900 may comprise at least some of substantially the same features and attributes as at least devices 700, 800 in FIGS. 10A-10B, except for being arranged with a substrate in the form of a drum 905 comprising an external drum surface forming a substrate portion 907 (e.g. substrate 24) instead of web 711 in FIG. 10A-10B. In some such examples, the substrate portion 907 may comprise at least some of substantially the same features and attributes as transfer member 423, 480 (e.g. FIGS. 8A-8B, 9A-9B). As further shown in FIG. 11, in some examples, device 900 may comprise a developer 802 (e.g. like developer 402) or preliminary portion (e.g. 380) upstream from the image formation portions 777A, 777B, etc. Upon formation of an image on substrate portion 907 along travel path P and completion of the dryer 745 (or similar energy radiating mechanism), the image is transferred from substrate portion 907 of drum 905 to image formation medium 946 via engagement with impression cylinder 930 of transfer station 960. Transfer station 960 may comprise at least some of substantially the same features and attributes as transfer station 760 in FIG. 10A.

FIG. 12A is a block diagram schematically representing an example control portion 1000. In some examples, control portion 1000 provides one example implementation of a control portion forming a part of, implementing, and/or generally managing the example portions of and/or entire image formation devices, as well as the particular portions, charge sources, fluid ejection devices, development units, liquid removal elements, transfer stations, elements, instructions, information, engines, and/or methods, etc. as described throughout examples of the present disclosure in association with FIGS. 1A-11 and 12B-14.

In some examples, control portion 1000 incorporates and/or comprises one example implementation of control portion 90 (FIG. 2).

In some examples, control portion 1000 includes a controller 1002 and a memory 1010. In general terms, controller 1002 of control portion 1000 comprises at least one processor 1004 and associated memories. The controller 1002 is electrically couplable to, and in communication with, memory 1010 to generate control signals to direct operation of at least some of the portions of, and/or entire, image formation devices, as well as the particular portions, charge sources, fluid ejection devices, development units, liquid removal elements, transfer stations, elements, instructions, information, engines, and/or methods, etc., as described throughout examples of the present disclosure. In some examples, these generated control signals include, but are not limited to, employing instructions 1011 and/or information 1012 stored in memory 1010 to at least direct and manage receiving and/or depositing droplets of ink particles and carrier fluid to form an image relative to a substrate, directing charges onto ink particles via a particular polarity, switching a polarity of emitted charges, removing liquids, transferring ink and the image-receiving holder layer (or a primer layer) onto an image formation medium, etc. as described throughout the examples of the present disclosure in association with FIGS. 1A-11 and 12B-14. In some such examples, the instructions 1011 and/or information 1012 may comprise instructions and/or information to implement the array 270 of parameters previously described in FIG. 3A and/or timing cycles of FIG. 3B. In some instances, the controller 1002 or control portion 1000 may sometimes be referred to as being programmed to perform the above-identified actions, functions, etc. In some examples, at least some of the stored instructions 1011 are implemented as, or may be referred to as, a print engine or image formation engine.

In response to or based upon commands received via a user interface (e.g. user interface 1020 in FIG. 12A) and/or via machine readable instructions, controller 1002 generates control signals as described above in accordance with at least some of the examples of the present disclosure. In some examples, controller 1002 is embodied in a general purpose computing device while in some examples, controller 1002 is incorporated into or associated with at least some of the portions of, and/or the entire, image formation devices, as well as the particular portions, charge sources, fluid ejection devices, development units, liquid removal elements, transfer stations, elements, instructions, information, engines, and/or methods, etc. as described throughout examples of the present disclosure.

For purposes of this application, in reference to the controller 1002, the term "processor" shall mean a presently developed or future developed processor (or processing resources) that executes machine readable instructions contained in a memory or that includes circuitry to perform computations. In some examples, execution of the machine readable instructions, such as those provided via memory 1010 of control portion 1000 cause the processor to perform the above-identified actions, such as operating controller 1002 to implement the image formation as generally described in (or consistent with) at least some examples of the present disclosure. The machine readable instructions may be loaded in a random access memory (RAM) for execution by the processor from their stored location in a read only memory (ROM), a mass storage device, or some other persistent storage (e.g., non-transitory tangible medium or non-volatile tangible medium), as represented by memory 1010. The machine readable instructions may include a sequence of instructions, a processor-executable machine learning model, or the like. In some examples, memory 1010 comprises a computer readable tangible medium providing non-volatile storage of the machine readable instructions executable by a process of controller 1002. In some examples, the computer readable tangible medium may sometimes be referred to as, and/or comprise at least a portion of, a computer program product. In other examples, hard wired circuitry may be used in place of or in combination with machine readable instructions to implement the functions described. For instance, in some examples, at least the controller 1002 and/or other components of the control portion 1000 may be embodied as part of at least one application-specific integrated circuit (ASIC), at least one field-programmable gate array (FPGA), and the like. In at least some examples, the controller 1002 and/or other components of the control portion 100 are not limited to any specific combination of hardware circuitry and machine readable instructions, nor limited to any particular source for the machine readable instructions executed by the controller 1002.

In some examples, control portion 1000 may be entirely implemented within or by a stand-alone device.

In some examples, the control portion 1000 may be partially implemented in one of the image formation devices and partially implemented in a computing resource separate from, and independent of, the image formation devices but in communication with the image formation devices. For instance, in some examples control portion 1000 may be implemented via a server accessible via the cloud and/or other network pathways. In some examples, the control portion 1000 may be distributed or apportioned among multiple devices or resources such as among a server, an image formation device, and/or a user interface.

Figure 12B:
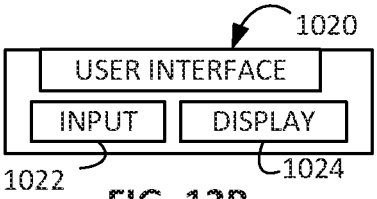

In some examples, control portion 1000 includes, and/or is in communication with, a user interface 1020 as shown in FIG. 12B. In some examples, user interface 1020 comprises a user interface or other display that provides for the simultaneous display, activation, and/or operation of at least some of the portions of, and/or the entire, image formation devices, as well as the particular portions, charge devices, fluid ejection devices, development units, liquid removal elements, transfer stations, elements, instructions, information, engines, and/or methods, etc., as described in association with FIGS. 1A-11A and 13-14. In some examples, at least some portions or aspects of the user interface 1020 are provided via a graphical user interface (GUI), and may comprise a display 1024 and input 1022.

Figure 13:
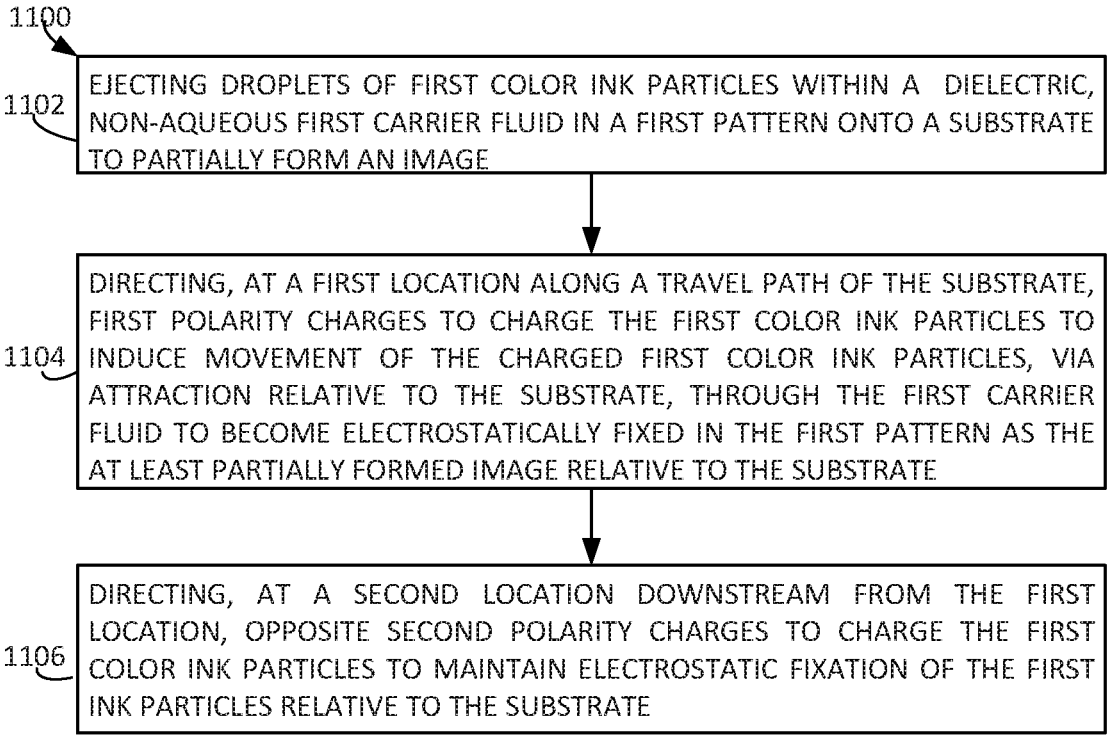
FIG. 13 is a flow diagram schematically representing an example method of image formation.

FIG. 13 is a flow diagram schematically representing an example method 1100 of electrophotographic printing. In some examples, method 1100 may be performed via at least some of the devices, portions, charge sources, substrates, ejection device, development units, liquid removal elements, transfer stations, engines, instructions, user interface, etc. as previously described in association with at least FIGS. 1A-12. In some examples, method 1100 may be performed via at least some devices, portions, charge sources, substrates, ejection device, development units, liquid removal elements, transfer stations, engines, instructions, user interface, etc. other than those previously described in association with at least FIGS. 1A-12.

As shown at 1102 in FIG. 13, method 1100 may comprise ejecting droplets of first color ink particles within a dielectric, non-aqueous first carrier fluid in a first pattern onto a substrate to at least partially form an image. As shown at 1104, in some examples method 1100 may further comprise directing, at a first location along a travel path of the substrate, first polarity charges to charge the first color ink particles to induce movement of the charged first color ink particles, via attraction relative to the substrate, through the first carrier fluid to become electrostatically fixed in the first pattern as the at least partially formed image relative to the substrate. As further shown at 1106 in FIG. 13, in some examples method 110 may comprise directing, at a second location downstream from the first location, opposite second polarity charges to charge the first color ink particles to maintain electrostatic fixation of the first ink particles relative to the substrate.

Moreover, in some examples method 1100 may comprise prior to the directing of opposite, second polarity charges, ejecting droplets of second color ink particles within a dielectric, non-aqueous second carrier fluid in a second pattern onto at least a portion of the first ink particles and the substrate to further form the image.

Figure 14:
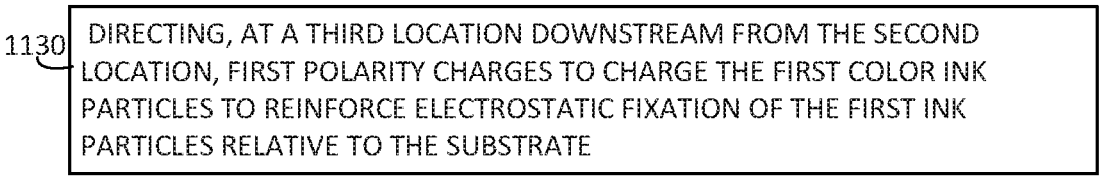
FIG. 14 is a flow diagram schematically representing at least a portion of an example method of image formation.

As further shown at 1130 in FIG. 14, in some examples, method 1100 may further comprise directing, at a third location downstream from the second location, first polarity charges to charge the first color ink particles to reinforce electrostatic fixation of the first ink particles relative to the substrate.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein.

The invention claimed is:

1. A device comprising:

a first portion to receive first color ink particles within a first fluid onto a substrate to form an image;

a first charge source to emit first polarity charges to charge the first color ink particles to move through the first fluid to become electrostatically fixed relative to the substrate;

a second portion to receive, relative to the substrate, second ink particles within a second fluid to further form the image;

a second charge source to emit opposite, second polarity charges to charge the second ink particles to move through at least a second carrier fluid and to charge the first color ink particles to electrostatically fix both the first and second color ink particles, relative to the substrate;

a media supply to supply a media as the substrate; and a ground element which is electrically connected to the media.

2. The device of claim 1, wherein the second charge source, via emission of the opposite, second polarity charges is to neutralize the first polarity charges on the first ink particles on the substrate and to apply the opposite, second polarity charges to the first ink particles on the substrate to electrostatically fix the first ink particles to the substrate.

3. The device of claim 1, wherein the respective first and second charge sources comprise a cold plasma generator.

4. The device of claim 1, wherein the second ink particles comprise a second color different from a first color of the first ink particles.

5. The device of claim 1, comprising:

a movement element to move the substrate along a travel path including the first portion, the first charge source, the second portion, and the second charge source; and a control portion to control, via the movement element, movement of the substrate along the travel path relative to a distance between the respective first and second charge sources in order to maintain electrostatic fixation of the first color ink particles relative to the substrate from the first charge source to the second charge source.

6. The device of claim 1, comprising:

an electrically conductive transfer member; and a preliminary portion upstream from the first portion to receive an electrically charged, semi-liquid image-receiving holder as the substrate onto the transfer member.

7. The device of claim 1, wherein each of the respective first and second portions comprise a fluid ejection device to eject the first and second ink particles, respectively, within the first and second fluids, respectively, onto the substrate.

8. The device of claim 1, comprising:

a liquid removal unit downstream from at least the first charge source to remove at least a portion of at least the first fluid from the substrate.

9. The device of claim 1, wherein the media is a flexible media.

10. The device of claim 1, wherein the media is a packaging media.

11. The device of claim 1, wherein the media is a flexible packaging media.

12. A device comprising:

a controller to cause a first fluid ejection device to deposit droplets of first color ink particles within a dielectric, non-aqueous first carrier fluid in a first pattern onto a substrate to partially form an image;

a first charge source to emit, at a first location along a travel path of the substrate, first polarity charges to charge the first color ink particles to induce movement of the charged first color ink particles, via attraction relative to the substrate, through the first carrier fluid to become electrostatically fixed in the first pattern as the at least partially formed image relative to the substrate; and a second charge source to emit, at a second location downstream from the first charge source, opposite second polarity charges to charge the first color ink particles to maintain electrostatic fixation of the first ink particles, via the opposite, second polarity charges, relative to the substrate.

13. The device of claim 12, wherein:

the controller is to cause a second fluid ejection device, interposed between the first charge source and the second charge source, to eject droplets of second color ink particles within the dielectric, non-aqueous second carrier fluid in a second pattern onto at least a portion of the first ink particles and the substrate to further form the image, wherein via the second charge source, the opposite second polarity charges are to charge the second color ink particles to induce movement of the charged second color ink particles, via attraction relative to the substrate, through at least the second carrier fluid to electrostatically fix the first and second color ink particles in the first pattern as the at least partially formed image relative to the substrate.

14. The device of claim 13, comprising:

a third charge source to emit, at a third location downstream from the second charge source, the first polarity charges to charge the first color ink particles to maintain the electrostatic fixation of the first ink particles, via the first polarity charges, relative to the substrate.

15. A method comprising:

ejecting droplets of first color ink particles within a dielectric, non-aqueous first carrier fluid in a first pattern onto a substrate to partially form an image;

directing, at a first location along a travel path of the substrate, first polarity charges to charge the first color ink particles to induce movement of the charged first color ink particles, via attraction relative to the substrate, through the first carrier fluid to become electrostatically fixed in the first pattern as the at least partially formed image relative to the substrate; and directing, at a second location downstream from the first location, opposite second polarity charges to charge the first color ink particles to maintain electrostatic fixation of the first ink particles, via the opposite, second polarity charges, relative to the substrate.

16. The method of claim 15, comprising:

prior to the directing of opposite, second polarity charges, ejecting droplets of second color ink particles within the dielectric, non-aqueous second carrier fluid in a second pattern onto at least a portion of the first ink particles and the substrate to further form the image; and charging the second ink particles via the directed opposite, second polarity charges to move toward and become electrostatically fixed relative to the substrate.

17. The method of claim 15, comprising:

via the directed opposite, second polarity charges, neutralizing the first polarity charges on the first ink particles on the substrate simultaneous with the electrostatic fixation of the first ink particles to the substrate via the opposite, second polarity charges.

* * * * *